US005680311A

United States Patent [19]

Trsar et al.

[11] Patent Number: 5,680,311

[45] Date of Patent: Oct. 21, 1997

[54] LONG TERM FIRING AND SPARK DISPLAY

[75] Inventors: Dale A. Trsar, Mt. Prospect; Yosuf M. Taraki, Evanston, both of Ill.

[73] Assignee: Snap-on Tools Company, Kenosha, Wis.

[21] Appl. No.: 566,375

[22] Filed: Dec. 29, 1995

[51] Int. Cl.[6] ..... G06G 7/70; F02P 17/00; G09G 5/36

[52] U.S. Cl. ..... 364/431.03; 364/431.01; 364/424.034; 364/424.035; 364/487; 324/379; 324/121 R; 73/117.3; 73/116; 345/140

[58] Field of Search ..... 364/431.01, 431.02, 364/431.03, 431.07, 431.09, 481, 483, 487, 550, 551.01, 431.04, 424.034, 424.035, 424.039; 324/379, 378, 384, 394, 103 P, 772, 121 R; 345/24, 140, 133, 134, 10; 73/117.3, 116

[56] References Cited

U.S. PATENT DOCUMENTS

| | | | |
|---|---|---|---|
| 3,789,658 | 2/1974 | Olsen | 73/117.3 |
| 3,906,437 | 9/1975 | Brandwein et al. | 73/117.3 |
| 3,990,302 | 11/1976 | Reeves et al. | 73/116 |
| 4,135,246 | 1/1979 | McMannis | 364/551.01 |
| 4,145,746 | 3/1979 | Trussell et al. | 364/431.02 |
| 4,417,467 | 11/1983 | Higgs et al. | 73/117.3 |
| 4,424,709 | 1/1984 | Meier, Jr. et al. | 73/117.3 |
| 4,783,991 | 11/1988 | Wixon | 73/117.3 |
| 4,812,768 | 3/1989 | Quinn | 364/551.01 |
| 5,034,893 | 7/1991 | Fisher | 364/431.01 |
| 5,132,909 | 7/1992 | Schroeder et al. | 364/431.03 |
| 5,247,287 | 9/1993 | Jonker et al. | 364/431.04 |
| 5,250,935 | 10/1993 | Jonker et al. | 364/431.04 |
| 5,296,869 | 3/1994 | Jonker et al. | 364/431.04 |
| 5,387,870 | 2/1995 | Knapp et al. | 364/431.04 |
| 5,396,427 | 3/1995 | Piehl et al. | 364/431.04 |

*Primary Examiner*—Jacques Louis-Jacques
*Attorney, Agent, or Firm*—Emrich & Dithmar

[57] ABSTRACT

An engine analyzer for plotting engine cylinder firing or spark voltage information, corresponding to distinct points of a cylinder firing waveform, in histograph form to assist in identifying a cylinder-misfire condition. In an illustrative embodiment, two traces are provided. The lower trace depicts a histograph, representative of the firing or spark voltage and engine speed of each cylinder over successive engine cycles. The histograph consists of successive pairs of adjacent, vertical histo-bars, each pair representing voltage and engine speed for a single cylinder. The first histo-bar in each pair represents the spark or firing voltage for a given cylinder and the second histo-bar represents the instantaneous engine speed measured over the duration of the given cylinder. The vertical histo-bar pairs are plotted sequentially from left to right, representing successive cylinder firings. The vertical histo-bars may be of one or more colors so that the associated plot for a given cylinder of interest is easily identified. The histographs are available in both live and freeze mode. An upper trace displays primary or secondary waveforms for one or more selected cylinders.

12 Claims, 15 Drawing Sheets

LONG TERM FIRING AND SPARK DISPLAY

BACKGROUND OF THE INVENTION

1. Field of the Invention

The present invention relates to methods and apparatus for electronically displaying information regarding the performance of internal combustion engines, and more particularly, to engine analyzers for plotting engine cylinder firing and spark information in histograph form to assist in identifying a cylinder-misfire condition.

2. Description of the Prior Art

The display in kilovolts of the peak voltage across the spark plug for each cylinder firing of an internal combustion engine, is a principal diagnostic technique utilized in numerous prior engine analyzers.

It is quite common to use bar graphs to display variations in peak voltage between firing cycles. The bar graph results are useful to show a cylinder-misfire condition, particularly as the instantaneous speed of the running engine under-test is caused to fluctuate.

Peak voltage bar graphs, such as that disclosed in U.S. Pat. No. 4,812,768 to Quinn, owned by the assignee of the present invention, are provided mainly for measurement of the kilovolt values of the secondary voltages for each firing cylinder. Two modes of operation are described: live and freeze modes. In the live waveform mode, peak voltage is represented by horizontally extending bars representative of the most recent KV sample taken for each cylinder. The instantaneous engine speed is also displayed. The lead connections for the taking of peak-voltage measurements, as well as RPM (engine speed) measurements are conventional. In the freeze mode, an RPM Set point feature allows the operator to select an RPM value at or above which the Freeze feature is activated automatically so that data otherwise displayed on the screen, and with reference to a particular speed value, is saved for analysis. The freeze feature provides a completely still picture of the KV of each cylinder of a particular engine at or near a particular engine speed.

The KV history of a particular cylinder over a number of engine cycles is displayed in bar graph form, known as a "histograph", in U.S. Pat. No. 5,247,287 to Jonker et al. This history is stored in a large buffer memory providing storage for such waveform information as primary ignition patterns for all cylinders, secondary patterns for all cylinders, etc., for later viewing.

Recent advances in integrated circuit memory devices, the low manufacturing cost of such components, and the increased processing speed of digital processing equipment, now makes feasible capturing of vast amounts of data and analyzing it to arrive at quick solutions to problems that just a few years earlier would have been prohibitively expensive if not impossible to implement.

Despite such advances, however, there remains a need to provide automotive technicians with a more useful, user-friendly tool for identifying and correcting cylinder misfires. Until now, there has been no diagnostic tool that allows a technician to capture multiple, successive engine firing cycles, and to view them, in an intelligible, comparative manner, against captured engine speed information, in either live or freeze modes. There has also not been available a way for a technician to view KV histograph data, including primary firing and/or secondary cylinder spark histories, simultaneously with the ignition waveform of a selected cylinder.

SUMMARY OF THE INVENTION

It is a general feature of the invention to provide a voltage histograph simultaneously with a graphical representation of RPM for plural successive engine cycles.

A further feature of the invention is the simultaneous display of a voltage histograph of plural, successive engine cycles (represented by consecutive, highlighted frames) together with the individual ignition waveforms for one or more cylinders of a selected frame.

These and other features of the invention are attained by an improvement to a system for analyzing the operation of a multiple cylinder internal combustion engine which provides an ignition voltage to each cylinder during each engine cycle. The system includes one or more signal pickups for sensing the ignition voltage for each cylinder as it fires, an RPM measuring source for computing engine speed during each cylinder firing, and a display device with a fixed-plot-area screen. The improvement includes a voltage plotting routine for graphically generating a first bar-histograph, plotted along a first axis, for viewing an ignition voltage, corresponding to a selected point of a cylinder firing waveform, for one or more cylinders over a plurality of successive engine cycles, and an RPM plotting routine for graphically generating a second bar-histograph, plotted along a second axis, for viewing instantaneous engine speed information for the plurality of successive engine cycles.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
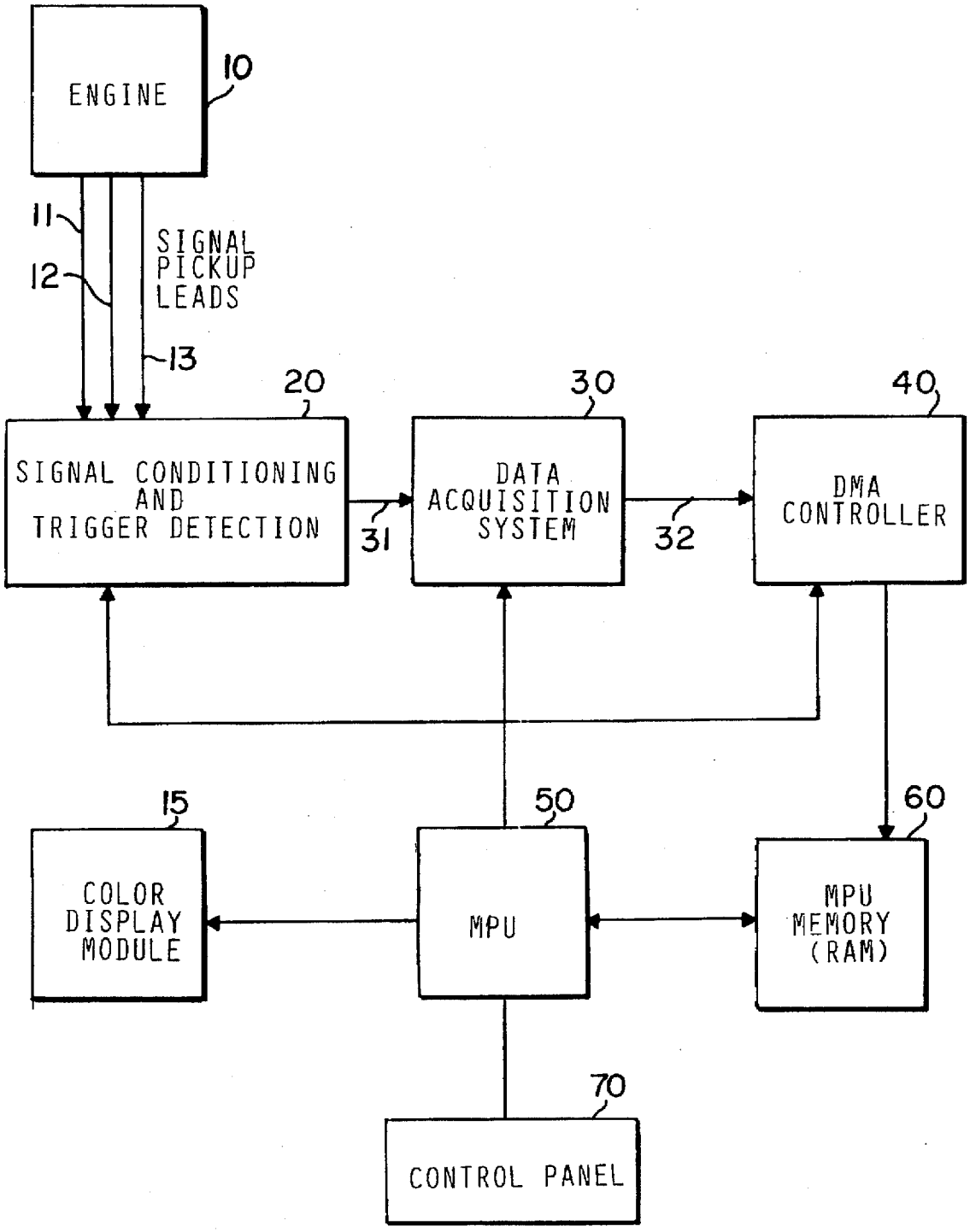
FIG. 1 shows a functional block diagram of a system in accordance with the present invention.
Figure 2:
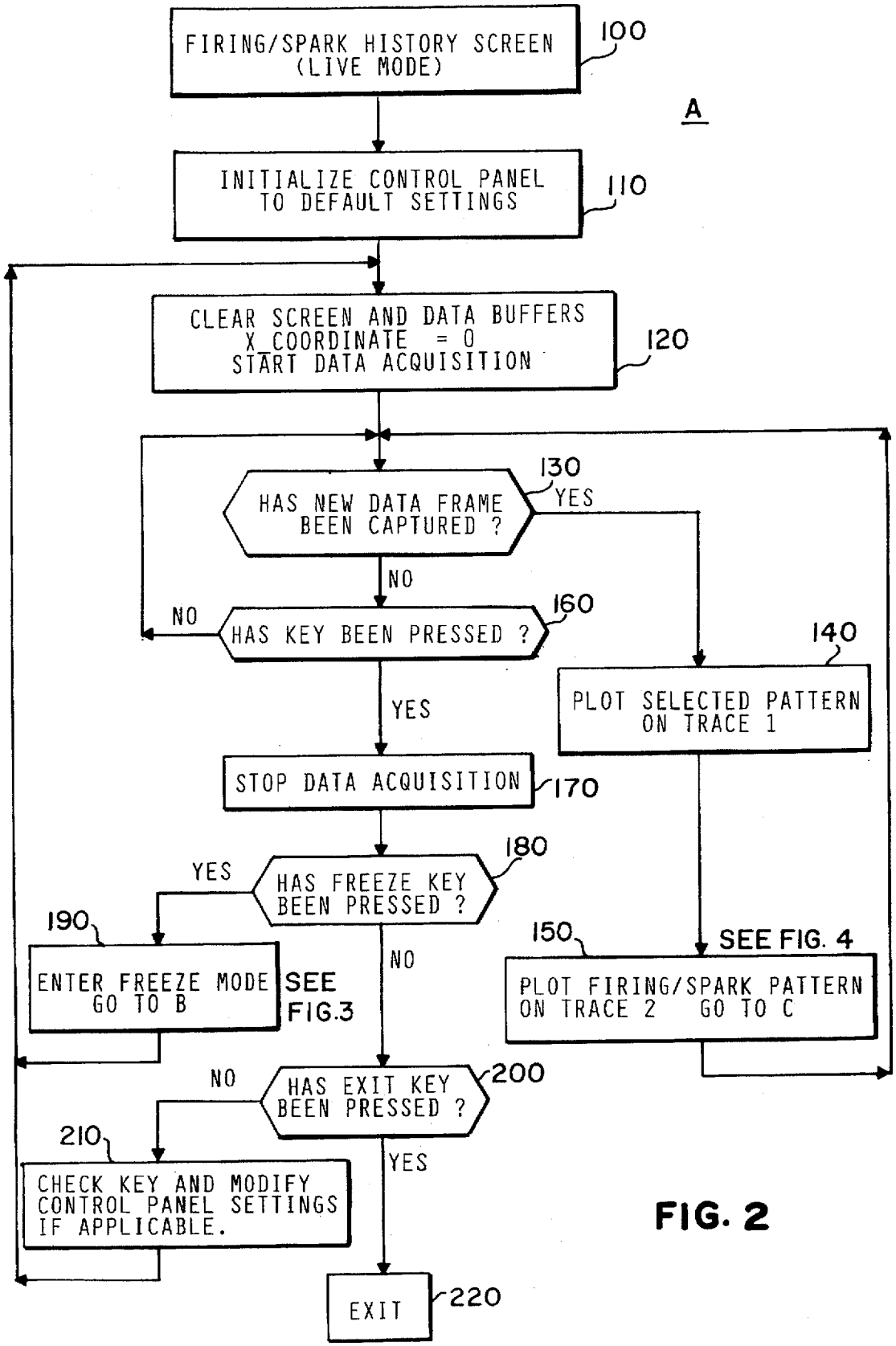
FIG. 2 is a flowchart of the main routine (live mode) for generating the voltage/RPM histographs in accordance with the present invention.
Figure 3:
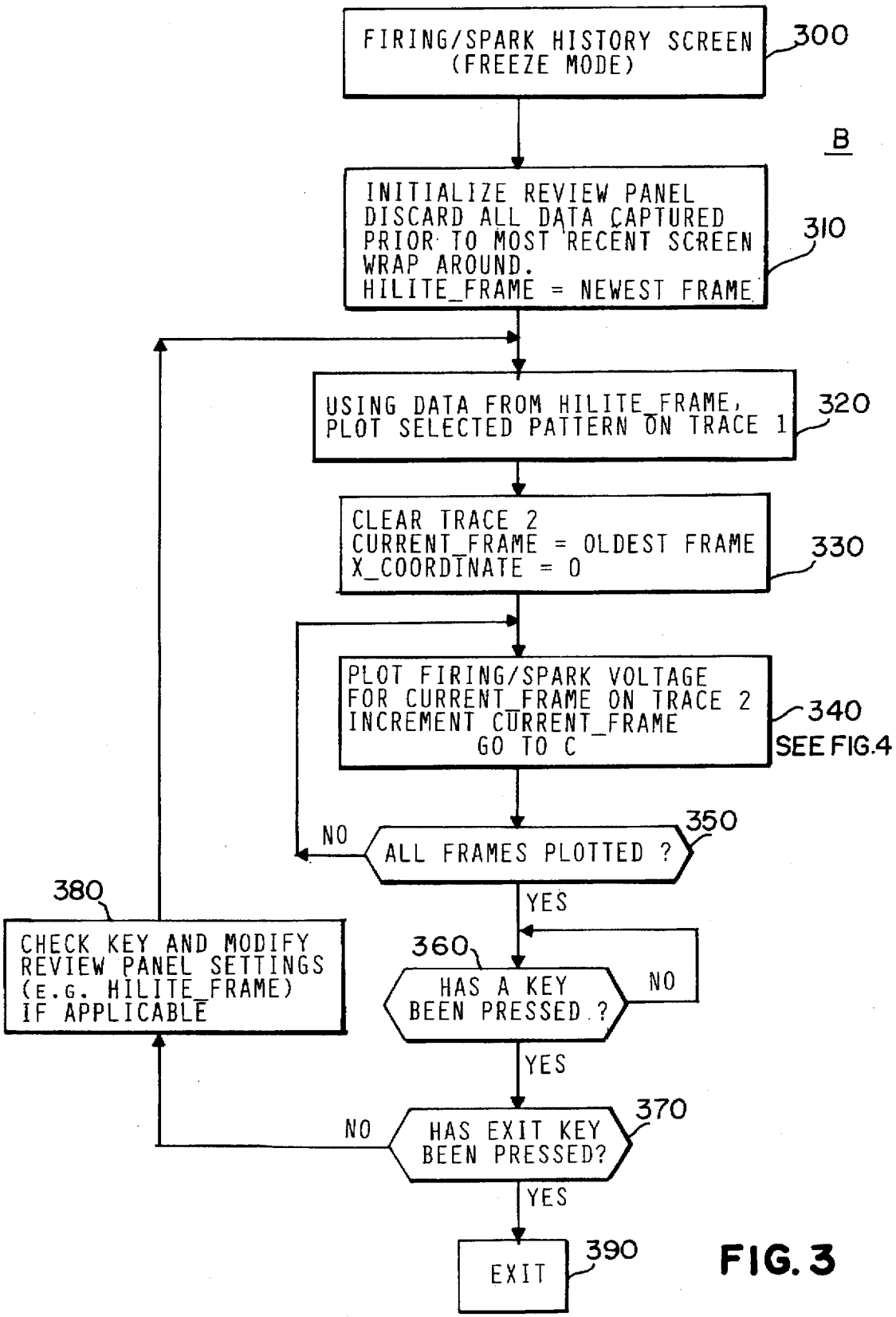
FIG. 3 is a flowchart of the routine (freeze mode) for plotting a firing or spark pattern.
Figure 4:
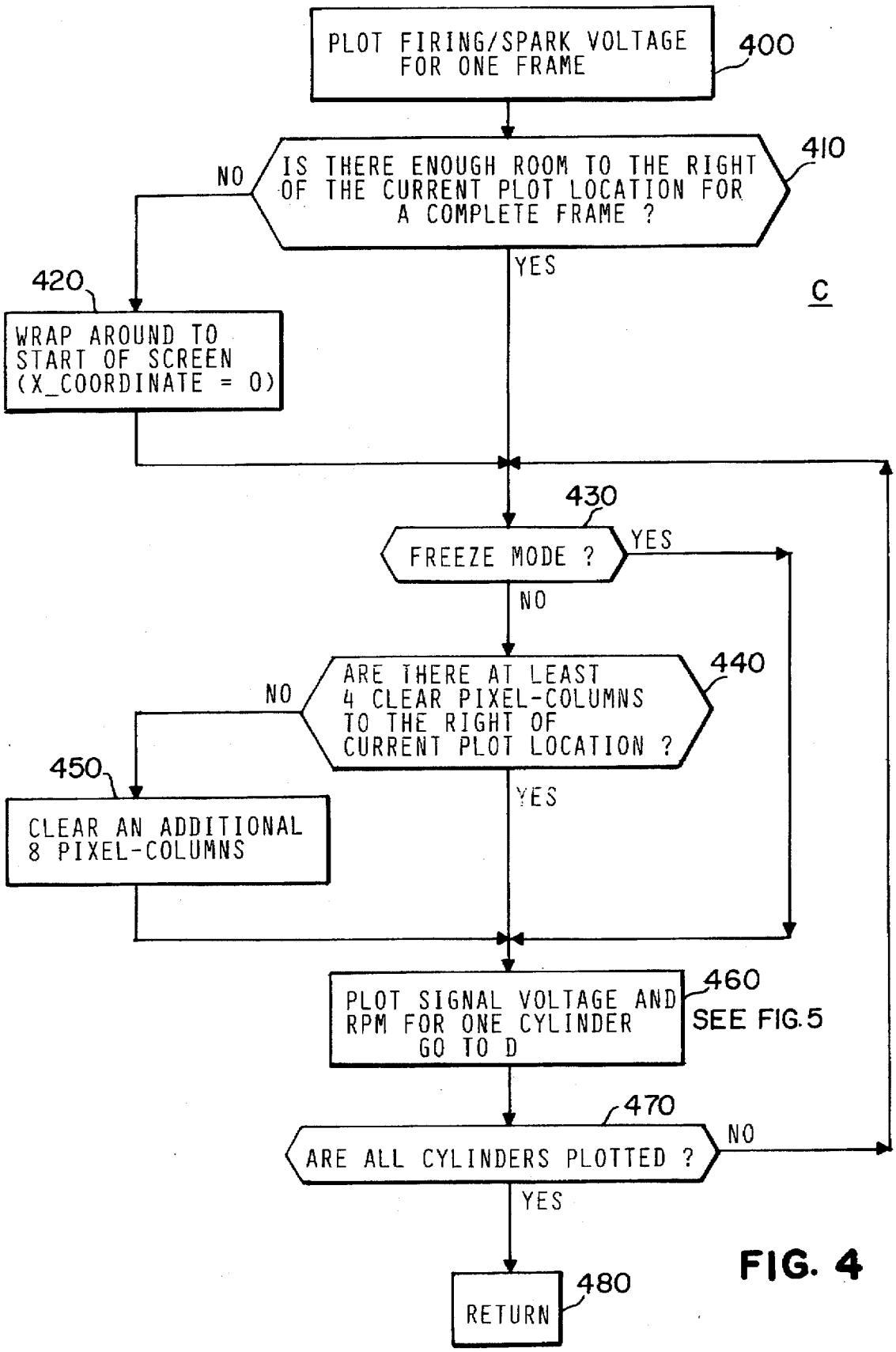
FIG. 4 is a flowchart of the routine for plotting each frame, corresponding to a full engine firing cycle, of a firing or spark pattern.
Figure 5:
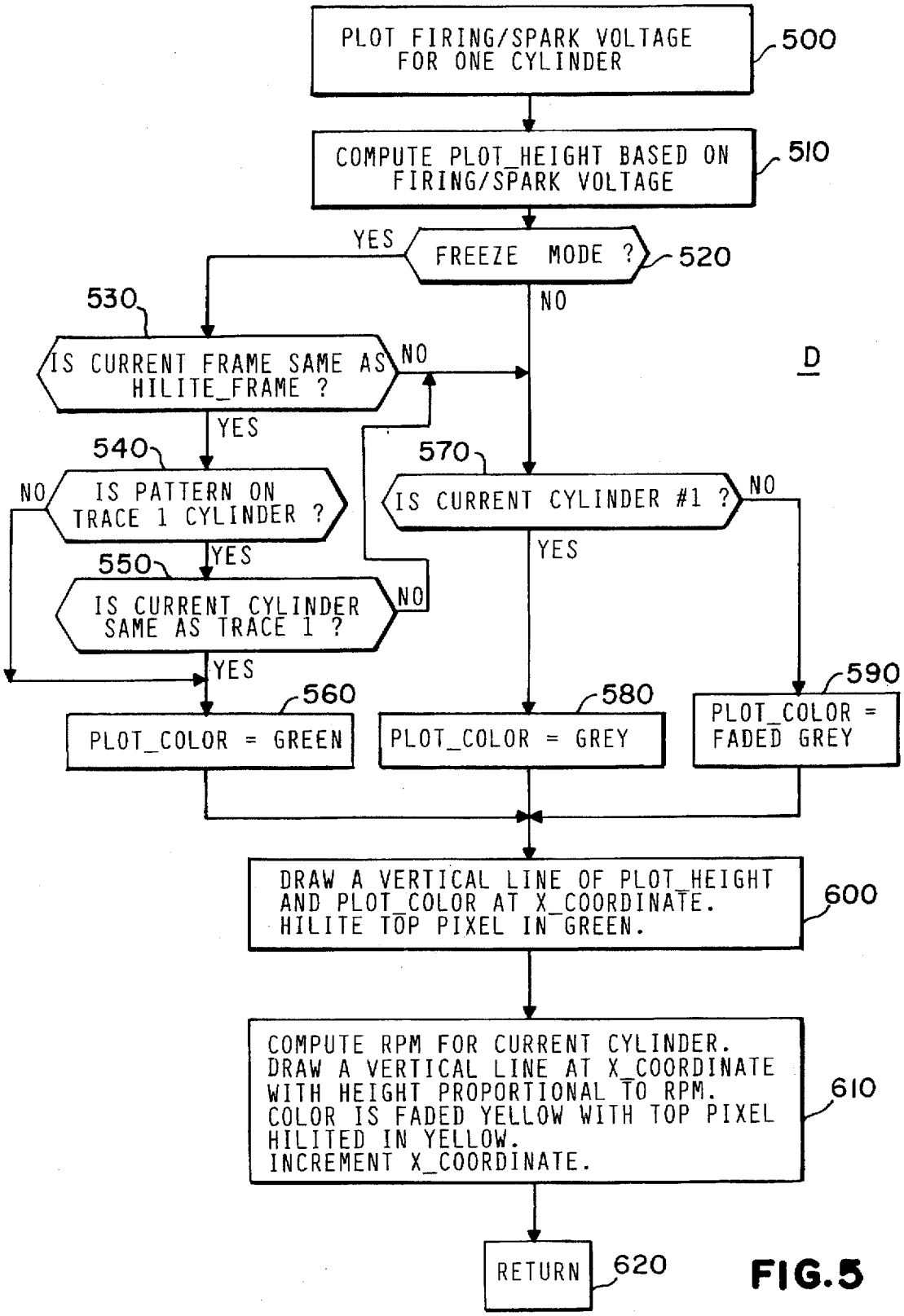
FIG. 5 is a flowchart of the routine for plotting the vertical-pixel information, including color and height of each representative signal.

Turning now to the drawings, and more particularly FIG. 1 thereof, there is depicted a data processing system, incorporating the features of the invention, as described in greater detail below in connection with FIGS. 2–4, to simultaneously display RPM and firing or spark pattern bar histographs along vertically spaced axes of a fixed-width area on a display module (screen) 15—preferably a color CRT monitor—based on signals captured from a running engine 10. Electrical signals are obtained from the engine 10 by means of signal pickup leads 11 and 12 and trigger pickup lead 13, which feed into a signal conditioning and trigger detection module 20. Module 20 converts the "raw" analog signals sensed on pickup leads 11 and 12—corresponding respectively to the primary and secondary ignition signals of the engine 10—to a form suitable for processing by a data acquisition system (DAS) 30. The conditioned signal is communicated to the DAS over line 31. DAS 30 transmits digital samples of the analog input signals and, under a direct memory access (DMA) controller 40 and MPU control 50, passes the digitized signals to an MPU random access memory 60. A suitable control panel 70 in the nature of a keyboard and/or mouse or the like is also provided.

The plotting of the firing or spark patterns simultaneous with RPM will now be described with reference to the program routines shown in FIGS. 2–5. Examples of some typical, dual-trace display screens in accordance with the present invention, are shown in FIGS. 6–15.

It should be appreciated that the present invention is operable in two distinct modes of operation: live mode and freeze mode, as well as in single trace t2 (firing or spark and RPM histograph only) and dual-trace mode including traces t2 and t1 (cylinder, parade or raster sweep) to assist the technician, for example, in easier diagnosing a misfire condition. It is further envisioned that, while one trace may be running in live mode, the other may be in freeze mode. A main routine A for plotting RPM and voltage histograph data, in live mode, is shown in FIG. 2. In live mode, the screen 15 is continuously updated with fresh voltage and RPM data from running engine 10. Freeze mode is initiated by pressing a FREEZE key (not shown) while in live mode. In freeze mode (routine B, FIG. 3), data acquisition is suspended and the operator is allowed to review previously captured data. Live mode will resume when freeze mode is terminated (by pressing FREEZE or ESCAPE key).

In live mode, trace 1 (t1) and trace 2 (t2) operate independently of each other. Trace 1 (t1) displays a cylinder, parade, or raster pattern, as selected via a touch or mouse operated control/selection panel, and trace 2 (t2) displays the firing or spark pattern. Upon first entering a histograph display program (100), trace 2 (t2) will be cleared (110, 120). As successive frames are captured, the amplitude of the selected parameter (firing or spark voltage) for each cylinder in the frame is plotted as a live histograph progressing from left to right (130–150 and routine C). Each bar in the histograph will be a 1-pixel-wide vertical line whose height is proportional to the amplitude of the signal (510, routine D). The top pixel of this histo-bar is drawn in green, with the remaining pixels in one of two colors: grey if the cylinder is #1, faded green otherwise (520–600, routine D). Immediately following the voltage histo-bar there is an RPM histo-bar whose height is proportional to the "instantaneous" engine speed measured over the most recent cylinder period (610, routine D). The RPM histo-bar is also 1 pixel wide, with the top pixel displayed in yellow and the remaining pixels in faded yellow.

When the histograph reaches the right side of the screen, it will wrap around to the left side (410–420, routine C). As the histograph wraps and begins to progress to the right, a small area of the screen to the right of the latest data will be cleared periodically to maintain a gap between the new and old data (440–450, routine C).

Upon entering the Freeze mode (300, routine B), all data prior to the most recent screen wrap-around are discarded (310). The screen is cleared and re-drawn, thus eliminating the pre-wrap portion of the histograph on Trace 2 (t2).

Integer frame numbers are assigned to all saved data frames; zero is assigned to the most recent frame, preceding frames are assigned incrementally larger negative numbers. The data review software maintains a HILITE_FRAME number which is initialized to zero at the start of freeze mode, but can subsequently be modified by the operator via the review panel. Trace 1 will display data for the HILITE_FRAME, in whatever pattern is specified in the review panel. The pattern type is initially the same as the pattern which was selected on the control panel in live mode, but can be modified via the review panel. The portion of the histograph on trace 2 which corresponds to the pattern being viewed on trace 1 is highlighted in green. Only the voltage histo-bars are highlighted; the RPM histo-bars are drawn the same as usual. The number of highlighted voltage histo-bars depends on the pattern selected on trace 1. If trace 1 is showing a single cylinder pattern, only a single histo-bar corresponding to the displayed cylinder is highlighted. If trace 1 is showing a raster or parade pattern, the number of highlighted histo-bars will be the same as the number of cylinders. As the HILITE_FRAME number is modified via the review panel, the pattern on trace 1 will be updated with data for the selected frame, and the highlighted portion of the histograph on trace 2 will move to the location of the selected frame. This mechanism provides a close-up view of the highlighted frame.

Thus, it should be apparent that the present invention provides a very user friendly and practical way to plot engine cylinder firing or spark pattern information in histograph form to assist in identifying a cylinder-misfire condition. In the illustrative display screens shown in FIGS. 6–15, two traces t1, t2 are provided. The lower trace t2 depicts a KV histograph, representative of the firing or spark voltage of each cylinder firing over successive engine cycles, and is scaled on the left y-axis. An RPM histograph is scaled on the right y-axis, vertically spaced from the KV histograph and horizontally set-off therefrom such that associated vertical lines of each of the KV and RPM histographs are interlaced. Cylinder firings and RPM data are plotted in scrolled fashion along the x-axes. The curves (c), shown as black areas but which are normally adjacent, horizontally-spaced successive pixel-columns of different color(s), represent snap-acceleration conditions, with RPM quickly increasing and decreasing over plural successive engine cycles during a short period of time. For any particular cylinder, the firing or spark voltage and the RPM can be read. Though shown here in black and white, the vertical bars are preferably of varying colors so that the firing or spark of a given cylinder corresponds to a given color. A sliding buffer indicator window (B) may also be provided as shown in FIGS. 6–15 to assist a technician in more quickly discerning the relative position of a presently highlighted frame (a full engine cycle) being viewed in relation to the most recently captured frame in memory. In the illustrative embodiment, the most recent frame is logically at the top (FRAME #0) of the buffer, with the oldest frame (FRAME -#xx) being on the bottom (see FIG. 6).

Figure 6:
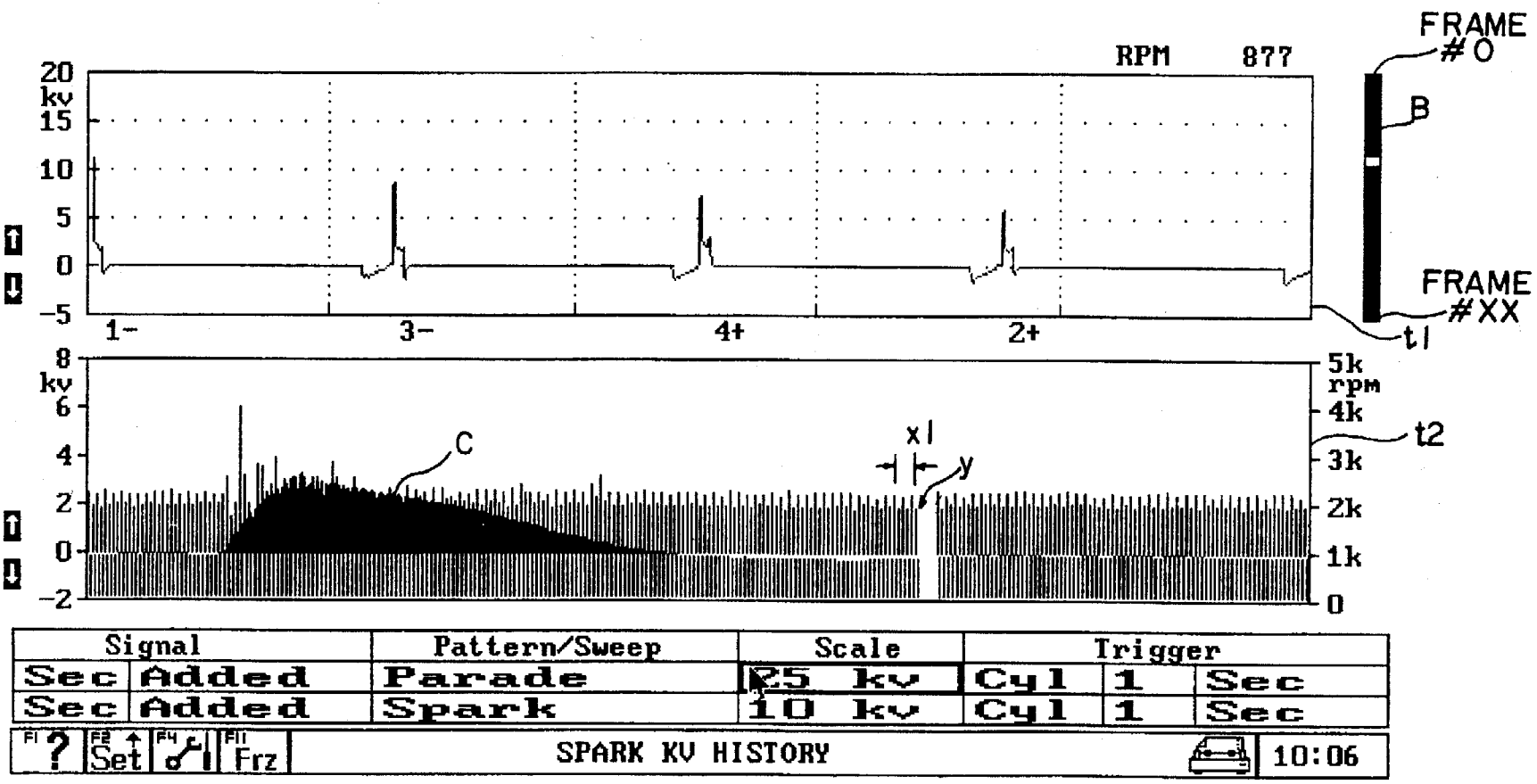
FIGS. 6–15 are various examples of screen displays generated in accordance with the present invention, including split-screen (dual-trace) configurations.

FIG. 6 shows a dual trace (t1, t2) histograph of engine cylinder firing pattern in live mode. A snap-acceleration condition is shown by black curve (c) drawn along spark KV history trace t2. The gap (y) in trace 2 indicates that a screen wrap-around condition has occurred. The top trace t1 shows a complete engine cycle firing pattern—in parade sweep pattern mode—of the most recently captured frame, represented by x1 in trace t2, and consisting of the full secondary voltage waveforms of the individual cylinders of a four-cylinder (distributorless) ignition system.

Figure 7:
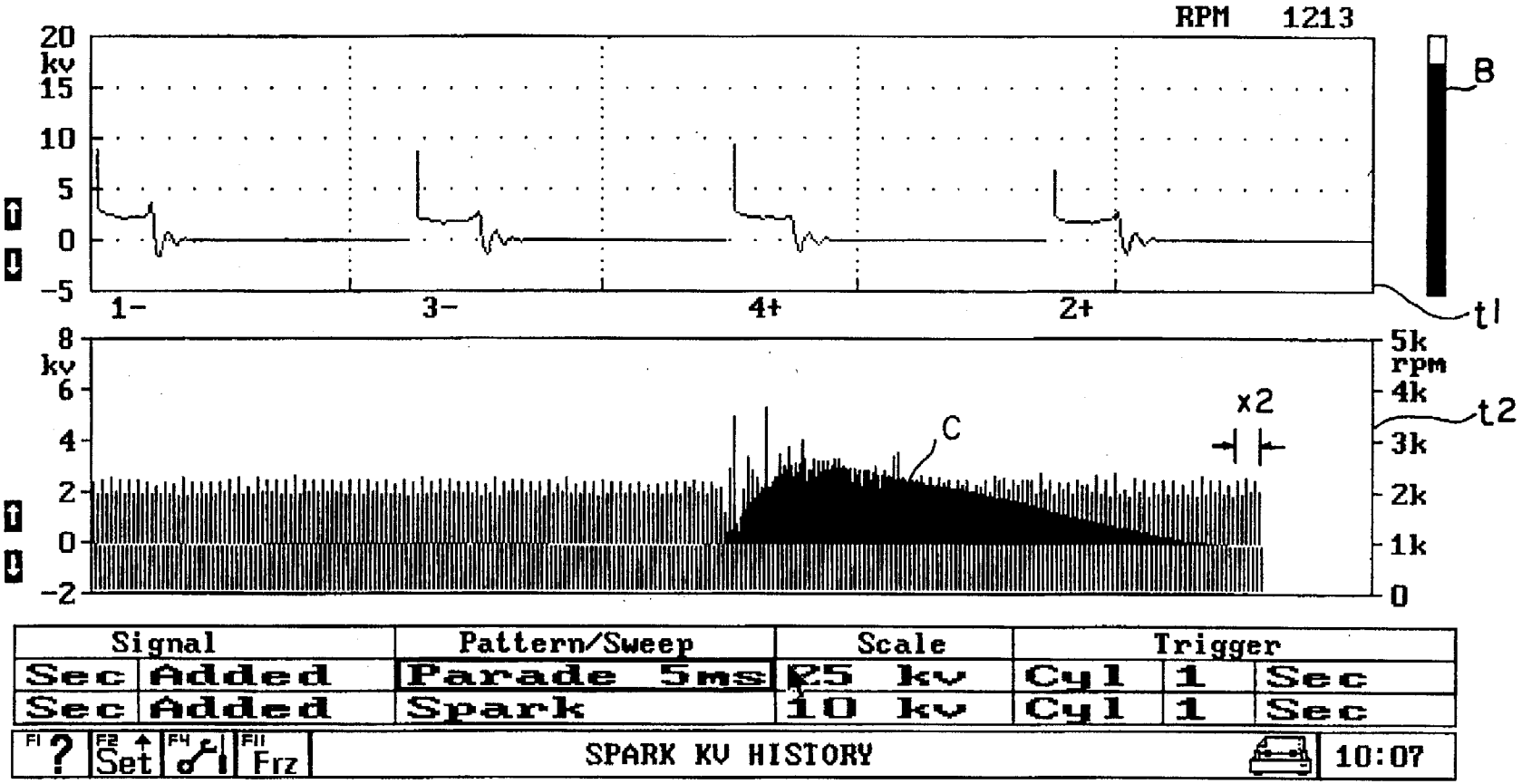

In FIG. 7, a display screen similar to that of FIG. 6 is shown, but with the corresponding trace t1 voltage waveforms of the engine cycle represented by frame x2 in trace t2, shown with a 5 ms parade sweep pattern. In the 5 ms parade sweep pattern mode, only the first five milliseconds of each cylinder waveform are selected for viewing, this portion of each cylinder waveform being the most useful for purposes of intuitive engine analysis. The rest of the cylinder waveform is cut-off. The trace t2 is different from that of FIG. 6 in that a wrap-around condition has not yet occurred.

Figure 8:
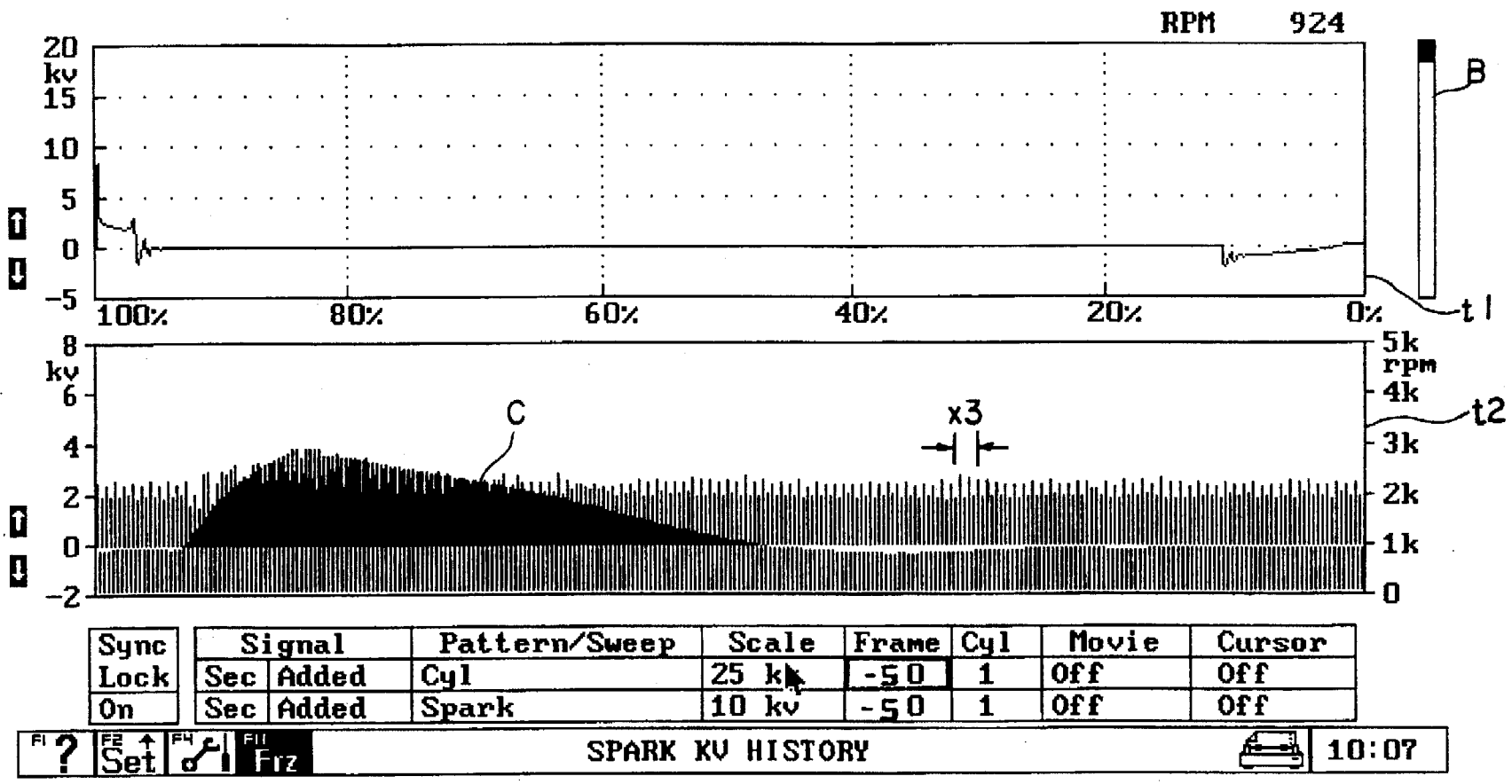

FIG. 8 shows a spark KV history (trace t2) of consecutive engine cycles in freeze mode—Frz icon shown inverse-highlighted. Trace t1 shows a full cylinder firing waveform corresponding to cylinder #1 of frame x3 in trace t2. The frame selected for viewing in trace t1, is typically, uniquely set-off by inverse highlighting or in colors, as described above, in trace t2, to provide the technician with a quick and intuitive way to identify the waveform plotted in trace t1.

Figure 9:
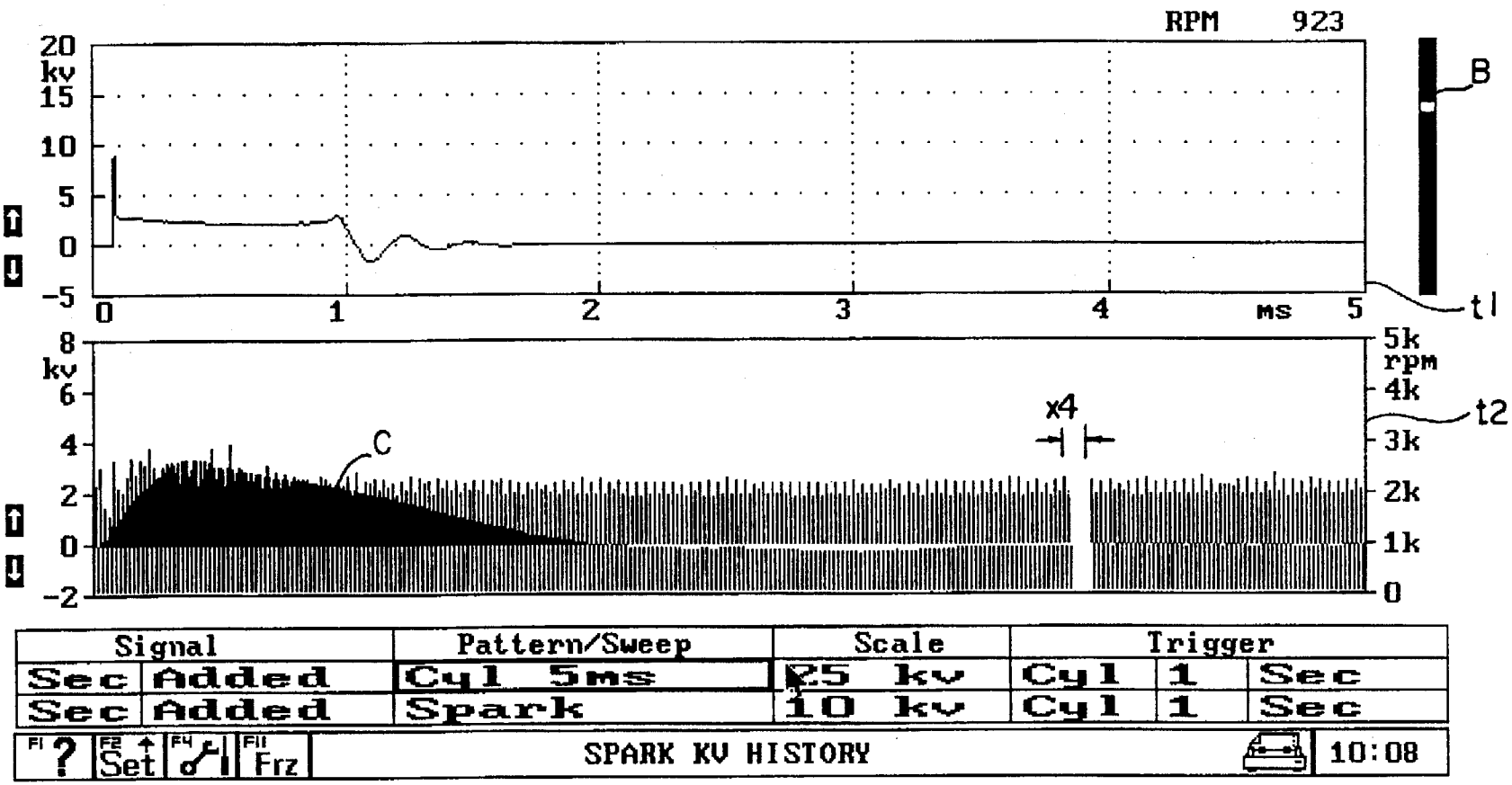

In FIG. 9, trace t2 shows a spark KV history, in live mode, and trace t1 shows a partial (first 5 ms) cylinder firing waveform corresponding to the waveform of cylinder #1 of frame x4 in trace t2.

Figure 10:
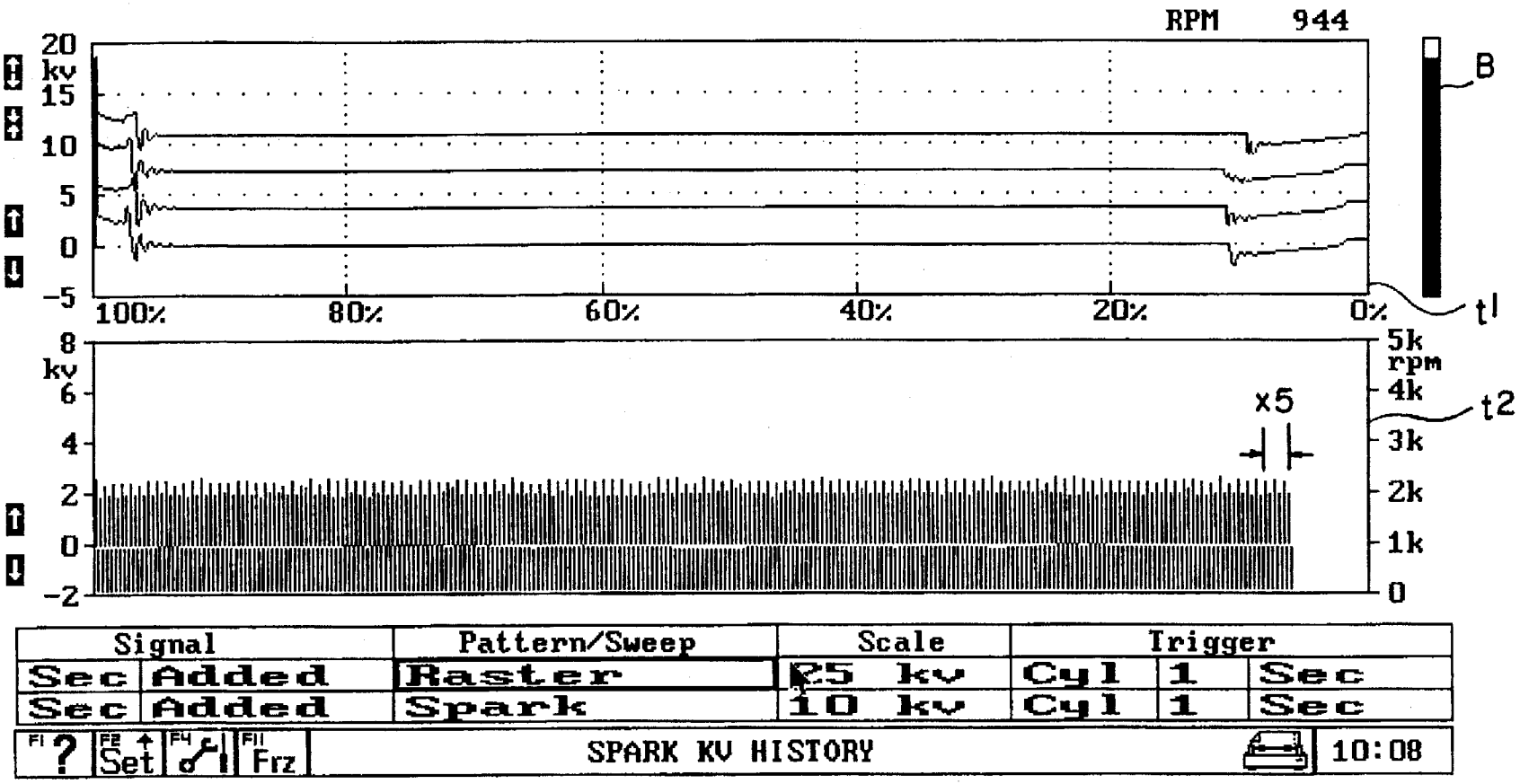

In FIG. 10, trace t2 shows a spark KV history, in live mode, with the full voltage waveforms of all the cylinders (1, 2, 3 and 4) corresponding to the full engine cycle, represented by frame x5 in trace t2, shown in raster (overlapping) sweep pattern mode in trace t1.

Figure 11:
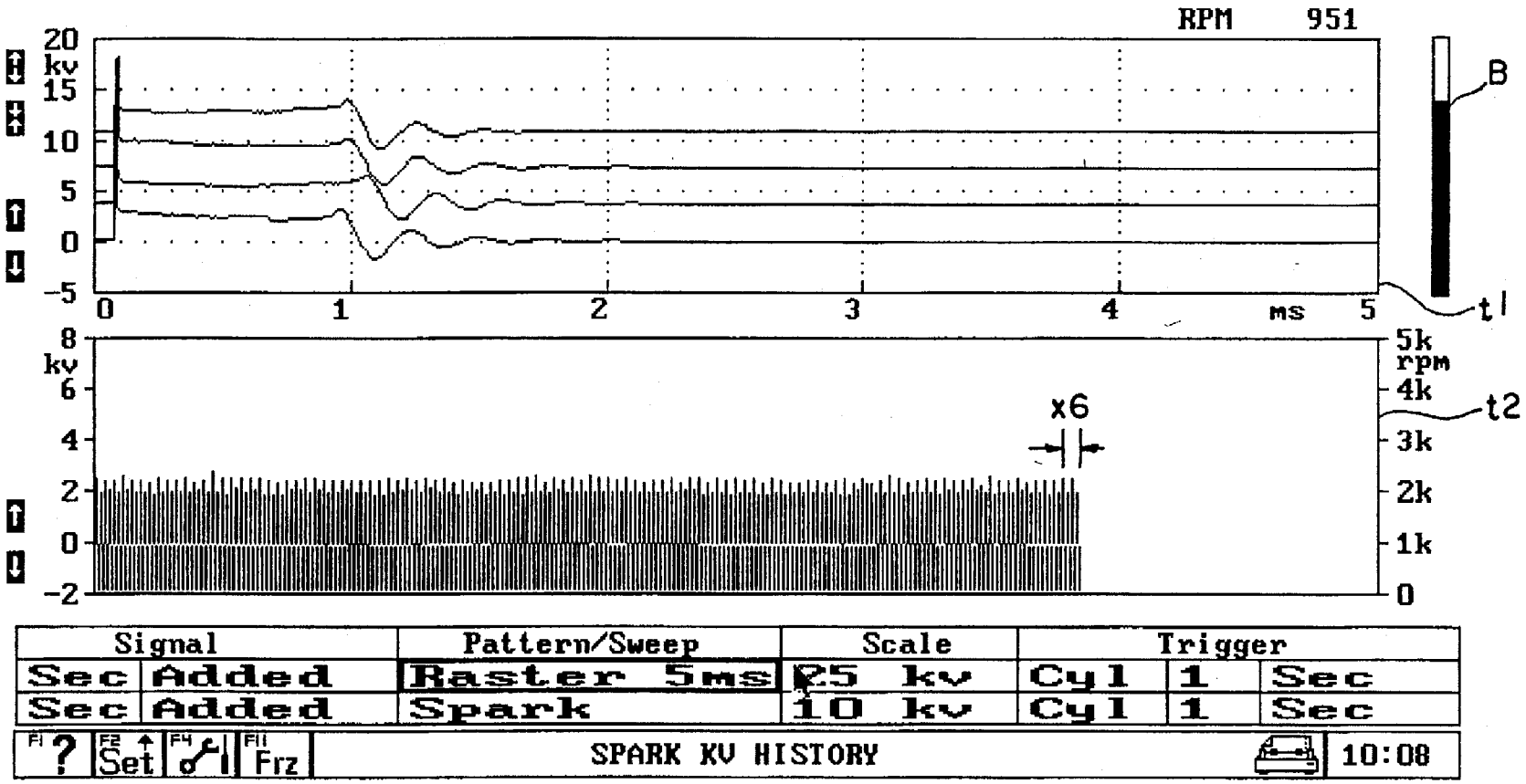

FIG. 11 is a display screen similar to FIG. 10, but with the corresponding trace t1 voltage waveforms of the engine cycle represented by the frame x6 in trace t2, shown in partial (5 ms) raster sweep pattern mode.

Figure 12:
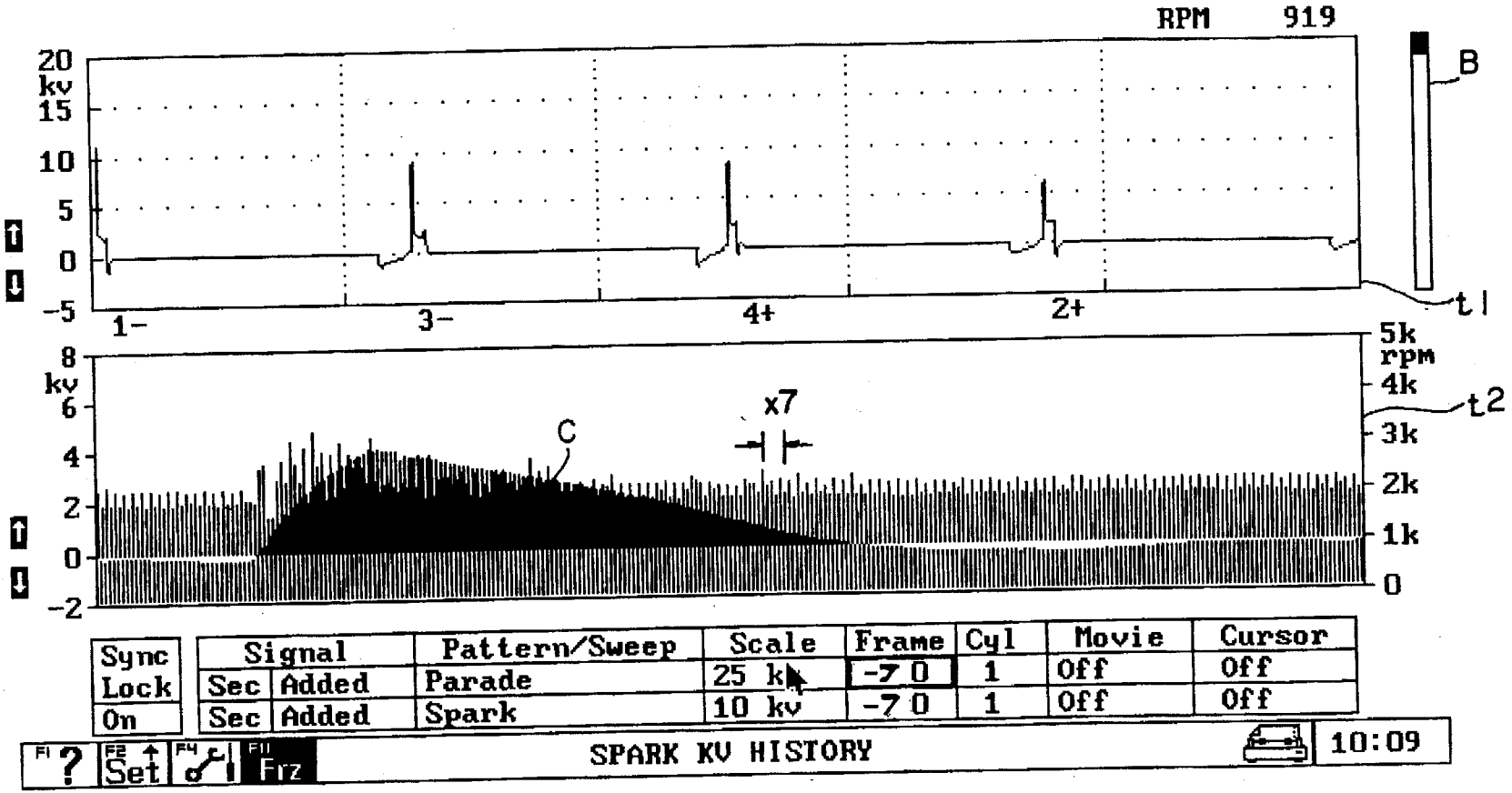

FIG. 12 is a freeze mode display screen showing a spark KV history in trace t2, with the parade sweep pattern of an engine cycle, represented by frame x7, shown in trace t1.

Figure 13:
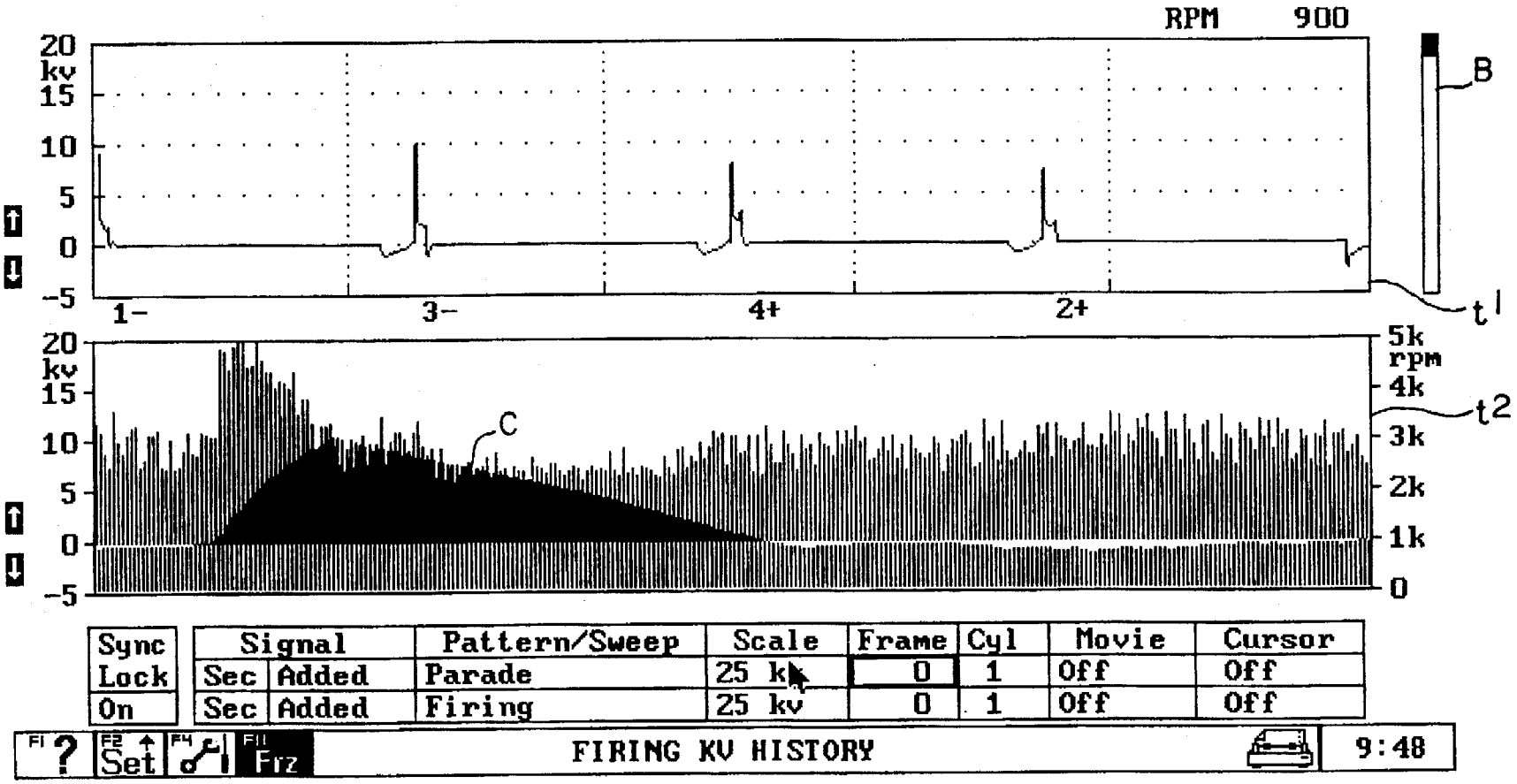

FIG. 13 is a freeze mode display screen similar to FIG. 12, but showing a firing KV history in trace t2.

Figure 14:
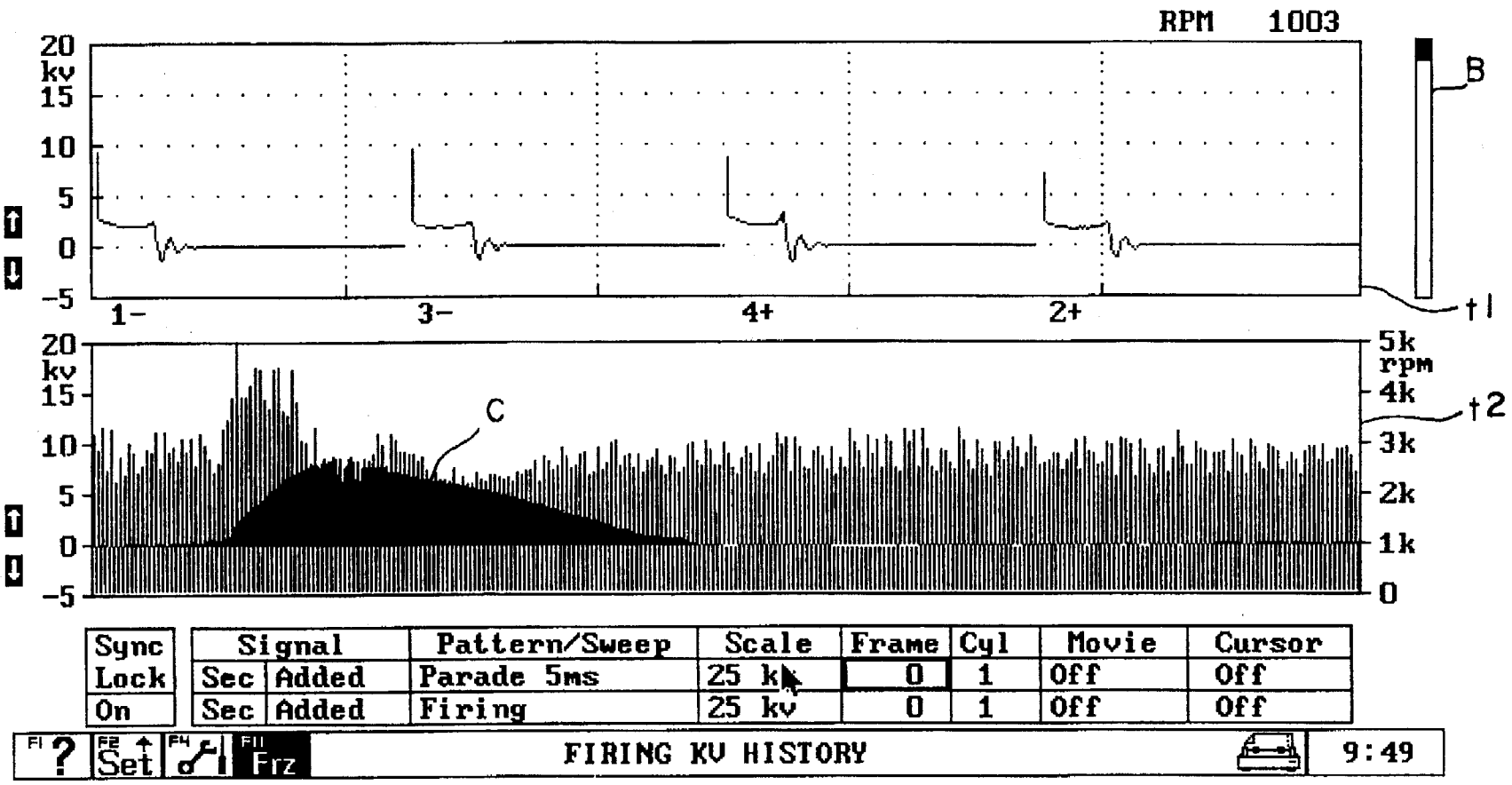

FIG. 14 is a freeze mode display screen similar to FIG. 13, but with the selected frame viewed for display in trace t1 shown in parade (5 ms) sweep pattern mode.

Figure 15:
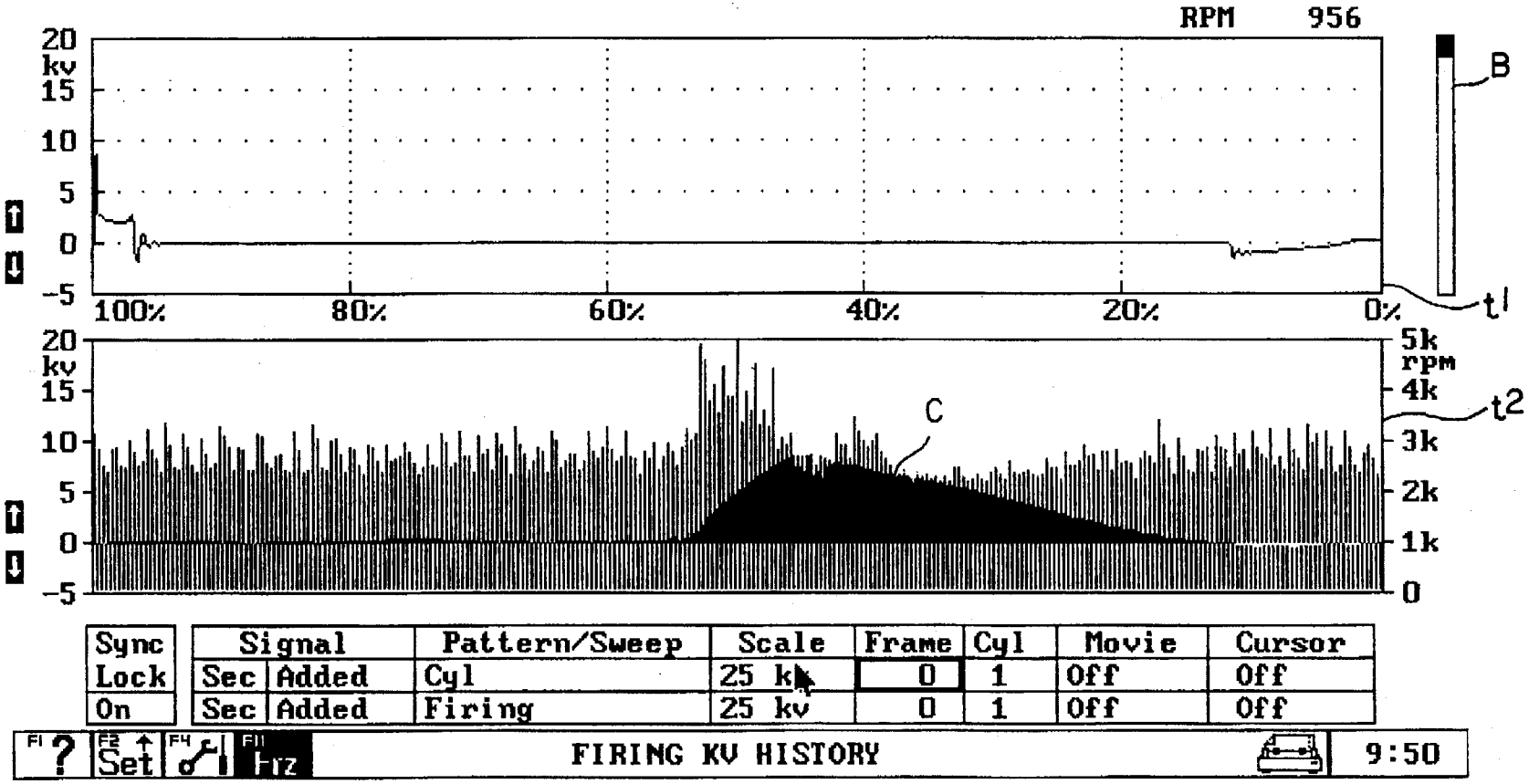

FIG. 15 is a freeze mode display screen similar to FIG. 14, but with only the #1 cylinder voltage waveform of a selected frame shown in trace t1.

While FIGS. 6–15 show KV histographs consisting of all the cylinder firings of successive engine cycles (frames), it should be appreciated that a single cylinder firing KV histograph could be depicted if desired.

Also, while FIGS. 6–15 show the voltage and RPMs histographs vertically spaced relative to each other, it should be appreciated that the respective voltage and RPM histograph axes may be, under operator control, variably offset relative to each other, and may even be plotted along the same axis position if desired.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. In a system for analyzing the operation of a multiple cylinder internal combustion engine which provides an ignition voltage to each cylinder during each engine cycle, including sensing means for sensing the ignition voltage-for each cylinder as it fires, RPM measuring means for continuously computing engine speed during each engine cycle, and a display device with a screen having a predetermined plot area, the improvement comprising:

voltage plotting means for graphically generating a first bar-histograph plotted along a first axis in the plot area for viewing an ignition voltage, corresponding to a selected point of a cylinder firing waveform, for one or more selected cylinders over a plurality of successive engine cycles, and RPM plotting means for graphically generating a second bar-histograph, plotted simultaneously with said bar-histograph along a second axis in the plot area, for viewing instantaneous engine speed information for said plurality of successive engine cycles.

2. The improvement of claim 1, wherein said voltage plotting means and said RPM plotting means include means for plotting said ignition voltage and said engine speed information, respectively, in both live mode and freeze mode.

3. The improvement of claim 1, wherein ignition voltage information and associated engine speed information are represented by at least partially horizontally-overlapping, corresponding one-pixel-wide vertical lines per engine cycle, the height of each vertical line being proportional to the amplitude of the respective voltage and RPM values.

4. The improvement of claim 3, wherein during live mode, said ignition voltage and associated engine speed information are plotted as a live, scrolling histograph, represented by plural vertical lines progressing from left to right in predefined equidistantly spaced increments across the screen, said improvement further comprising means for wrapping around to the left-most plottable pixel-column, overwriting the oldest plot data, after the scrolled data reaches the right-most pixel-column on the screen.

5. The improvement of claim 4, wherein said means for wrapping around includes means for clearing a predetermined number of pixel-columns immediately to the right of the most recently plotted pixel-column.

6. The improvement of claim 1, wherein said voltage and said RPM plotting means include means for separately coloring respective vertical lines of each said ignition voltage and said engine speed information.

7. The improvement of claim 1, further comprising dual trace means for providing a split-screen trace display, including an upper horizontal trace and a lower horizontal trace, said first and second histographs being plotted on one of the traces, with engine cycle or cylinder firing information being plotted on the other trace.

8. The improvement of claim 7, wherein said trace including said histographs includes one or more highlighted vertical pixel-columns corresponding to the cylinder or engine cycle pattern plotted in the other trace.

9. The improvement of claim 7, further comprising means for initializing trace viewing options, including means for selecting plotting of said cylinder or engine cycle pattern information in one of cylinder, parade, or raster sweep-pattern modes.

10. The improvement of claim 1, further comprising means for running one of said horizontal traces in freeze mode and the other in live mode.

11. The improvement of claim 10, wherein each engine cycle consists of multiple cylinder firing cycles collectively constituting a frame, said improvement further comprising a sliding buffer indicator window indicative of the relative position of the frame being viewed, in freeze mode, in relation to the most recent frame stored in memory.

12. The improvement of claim 1, wherein said first and second axes are spaced vertically relative to each other.

* * * * *